United States Patent [19]

Allec et al.

[11] Patent Number: 5,038,003

[45] Date of Patent: Aug. 6, 1991

[54] WATERPROOF ELECTRICAL SPLICE ENCLOSURE WITH SPECIALIZED HOUSING TO PREVENT THE WIRES FROM BEING REMOVED FROM THE WATERPROOF MATERIAL WITHIN THE HOUSING

[75] Inventors: Timothy J. Allec; William B. Furlong, both of Riverside, Calif.

[73] Assignee: T & B Industries, Inc., Riverside, Calif.

[21] Appl. No.: 522,681

[22] Filed: May 14, 1990

[51] Int. Cl.[5] ..... H01R 4/22

[52] U.S. Cl. ..... 174/138 F; 174/76; 174/87

[58] Field of Search ..... 174/74 A, 76, 77 R, 174/87, 91, 138 F; 439/367, 521, 523, 587, 588, 892

[56] References Cited

U.S. PATENT DOCUMENTS

| | | | |
|---|---|---|---|
| 3,523,607 | 8/1970 | Gillemot et al. | 174/76 X |
| 3,585,275 | 6/1971 | Gillemot et al. | 174/87 X |
| 3,597,528 | 8/1971 | Penfield et al. | 174/87 |
| 3,781,461 | 12/1973 | Thompson et al. | 174/76 X |
| 3,937,870 | 2/1976 | Bumpstead et al. | 174/87 |
| 4,039,742 | 8/1977 | Smith | 174/87 |
| 4,053,704 | 10/1977 | Smith | 174/87 |
| 4,070,543 | 1/1978 | Thompson et al. | 174/87 |
| 4,764,232 | 8/1988 | Hunter | 174/76 X |
| 4,783,227 | 11/1988 | Meador | 174/76 X |
| 4,839,473 | 6/1989 | Fox et al. | 174/87 X |

FOREIGN PATENT DOCUMENTS

| | | | |
|---|---|---|---|
| 593494 | 5/1925 | France | 174/87 |

*Primary Examiner*—Laramie E. Askin

*Attorney, Agent, or Firm*—Thomas I. Rozsa

[57] ABSTRACT

A two piece enclosure having a separate cover and a hollow body into which is placed a multiplicity of wires which have had the insulation stripped away adjacent their respective ends so they can be connected together by a connector. The hollow body is partially filled with a waterproof gel and the connector and ends of the connected wires are placed into the hollow body so that they are immersed within the waterproof gel. The top of the hollow body and the cover have aligned openings to permit a respective wire to extend out of the closed assembly through the aligned openings after the cover has been placed on the body. The cover further comprises a centrally disposed rod which extends transversely to the interior of the cover and is aligned with the connector. In this way, the wires can move through the aligned openings between the cover and the hollow body, and the connector and connected wires can be pulled on without causing the entire assembly to be pulled out of the ground, while the transverse rod serves to prevent the connector and the connected ends of the wires from being pulled out of the waterproof gel. The cover may also include a webbed opening to permit additional waterproof gel to be added after the cover is closed.

17 Claims, 1 Drawing Sheet

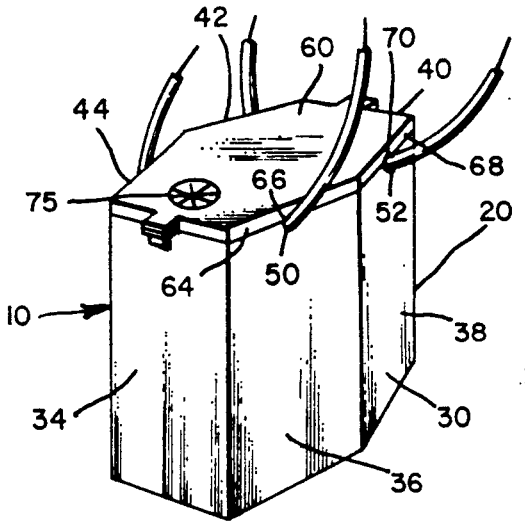
Fig. 1.
Fig. 2
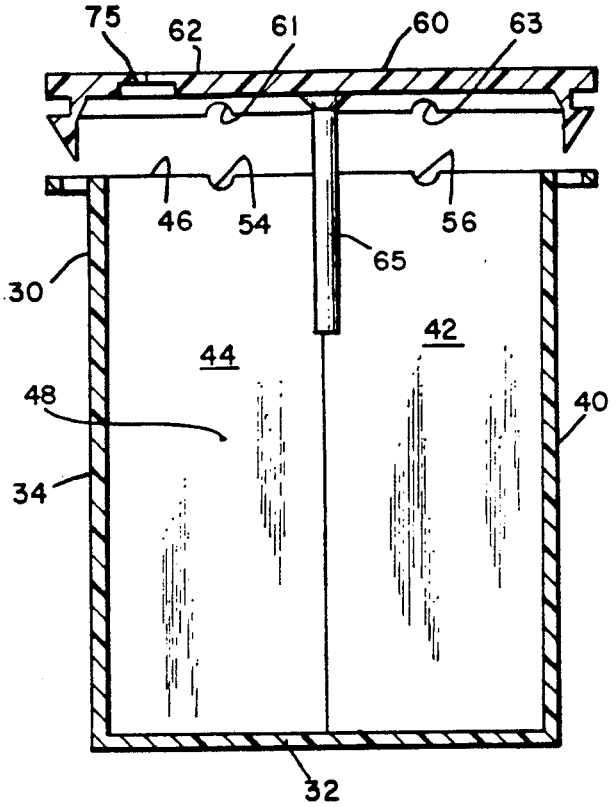
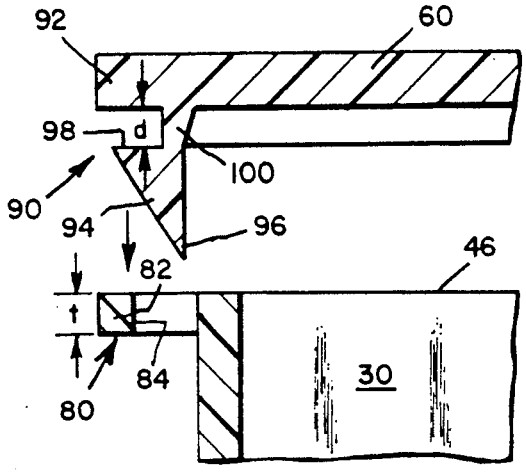
Fig. 4.
Fig. 3.
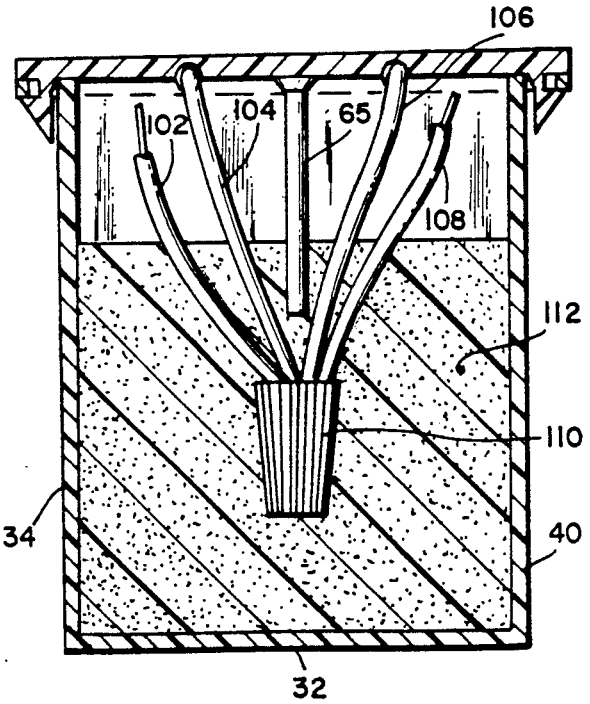
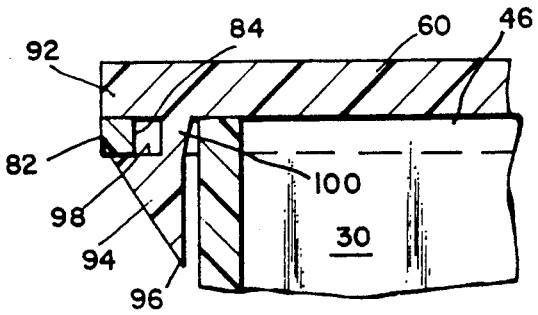
Fig. 5.

WATERPROOF ELECTRICAL SPLICE ENCLOSURE WITH SPECIALIZED HOUSING TO PREVENT THE WIRES FROM BEING REMOVED FROM THE WATERPROOF MATERIAL WITHIN THE HOUSING

BACKGROUND OF THE INVENTION

1. Field of the Invention

The present invention relates to the field of apparatus which are used to connect a multiplicity of wires together and retain them within a container having waterproof material therein. The present invention further relates to the field of containers for housing and retaining in the ground a multiplicity of wires which have been connected together and are embedded in a waterproof medium. Such connections are required for apparatus such as electrical watering systems.

2. Description of the Prior Art

The concept addressed by this invention and by related prior art inventions is to provide a container having a waterproof medium therein to safely house and retain electrical conductors at the location where the insulation on the conductors has been stripped away so that a multiplicity of such conductors can be connected together such as by twisting them together with a conventional connector. The following prior art patents address this problem in different ways:

1. U.S. Pat. No. 4,839,473 issued to Fox et al. on June 13, 1989 for "Waterproof Electrical Splice Enclosure".
2. U.S. Pat. No. 4,070,543 issued to Thompson et al. for "Encapsulated Splice Assembly And Method".
3. U.S. Pat. No. 4,053,704 issued to Smith for "Plug And Kit of Parts Including Same For Use In Forming A Moisture-Proof Cable Splice Enclosure".
4. U.S. Pat. No. 4,039,742 issued to Smith on Aug. 2, 1977 for "Waterproof Cable Splice Enclosure Kit".
5. U.S. Pat. No. 3,597,528 issued to Penfield et al. for "Electrical Connector For Insulating An Electrical Wire Joint".
6. U.S. Pat. No. 3,585,275 issued to Gillemot et al. for "Kit And Method For Encapsulating Conductor Splice Connections".
7. U.S. Pat. No. 3,523,607 issued to Gillemot et al. in 1970 for "Service Wire Encapsulating Kit".
8. U.S. Pat. No. 4,764,232 issued to Hunter on Aug. 16, 1988 for "Method of Protecting a Cable Splice With a Splice Closure Having Pressure Measuring Means".
9. U.S. Pat. No. 3,781,461 issued to Thompson et al. on Dec. 25, 1973 for "Cable Splice Assembly And Method".
10. U.S. Pat. No. 4,783,227 issued to Meador on Nov. 8, 1988 for "System And Method For Sealing A Buried Cable Splice".

U.S. Pat. No. 4,839,473 discloses an electrical splice enclosure which includes a one-piece assembly having a body and an affixed cap which houses a multiplicity of wires tightened together with a wire nut inside a waterproof medium. Incorporated within the cap is a bulbous protrusion which presses the wires against the wall of the container to thereby retain them in the medium. While this represents one type of acceptable splice enclosure, one problem with this system is that the bulbous protrusion which substantially presses the wires against the wall of the container to retain them may press too tightly against the wire and cause it to break, thereby severing the connection. In addition, if it is necessary to pull on the wire, the bulbous protrusion permits no play on the wire and the entire capsule may be pulled out of the ground. Since there is no give due to the press fit of the bulbous protrusion against the container wall, a sharp tug on one of the connected wires may in addition to pulling the entire container out of the ground cause the wires to become disconnected.

The patents set forth above in numbers 2 through 7 were cited in U.S. Pat. No. 4,839,473 and represent various other splice assemblies which are cumbersome to install and are not as efficient as the invention in U.S. Pat. No. 4,839,473.

U.S. Pat. No. 4,783,227 issued to Meador shows a system and method for sealing a buried cable splice which employs a settable sealing liquid around splice 47. The cables are held in place by a split bolt clamp such as 48. Therefore, that is the method by which the cables are held within the container. The cap itself is merely a form-fitting cap with openings to accommodate the cable therethrough and simply slides over the outside of the container.

U.S. Pat. No. 3,781,461 issued to Thompson et al. relates to a cable splice assembly and method employing a water repellant gel 65.

U.S. Pat. No. 4,764,232 to Hunter discloses a cable splicing method employing a curable liquid sealant.

Therefore, there is a significant need for an assembly which efficiently retains a multiplicity of wires in a waterproof medium within a housing and which at the same time permits the wires to be moved a little for adjustment without causing the container to be pulled out of the ground, without pinching the wires to possibly sever one, and which at the same time assures that the wires will remain in the waterproof medium when they are pulled.

SUMMARY OF THE PRESENT INVENTION

The present invention relates to a two piece enclosure having a separate cover and a hollow body into which is placed a multiplicity of wires which have had the insulation stripped away adjacent their respective ends so they can be connected together by a connector. The hollow body is partially filled with a waterproof gel and the connector and ends of the connected wires are placed into the hollow body so that they are immersed within the waterproof gel. The top of the hollow body and the cover have aligned openings to permit a respective wire to extend out of the closed assembly through the aligned openings after the cover has been placed on the body. The cover further comprises a centrally disposed rod which extends transversely to the interior of the cover and is aligned with the connector. In this way, the wires can move through the aligned openings between the cover and the hollow body, and the connector and connected wires can be pulled on without causing the entire assembly to be pulled out of the ground, while the transverse rod serves to prevent the connector and the connected ends of the wires from being pulled out of the waterproof gel.

It has been discovered, according to the present invention, that a multiplicity of wires can be safely connected and retained in the ground by placing the wires which have been connected through connecting means into a hollow body which is partially filled with a waterproof gel into which the connecting means and connected wires are immersed. The hollow body is sealed by a separate cover which comprises openings aligned with the openings in the top of the hollow body to permit the wires to exit the closed container.

It has further been discovered, according to the present invention, that if the cover further comprises a transverse rod which extends generally perpendicular to the interior surface of the cover and is aligned with the wire connecting means, then the rod will serve to prevent the connecting means and connected wire ends from being pulled out of the waterproof gel while at the same time permitting the wires to be slightly pulled on for adjustment.

It has additionally been discovered, according to the present invention, that if the cover further comprises a webbed opening, after the connecting means and connected wires are placed in the hollow body and the cover is closed, the user can insert waterproof compound or waterproof gel into the hollow body.

It is therefore an object of the present invention to provide a two piece electrical splice enclosure which permits wires to be safely and efficiently connected together and immersed in a waterproof gel while at the same time providing a closure means which permits the wires to be pulled on for slight adjustment and at the same time providing means to prevent the wire connecting means and the connected ends to be pulled out of the protective waterproof gel.

It is a further object of the present invention to provide an electrical splice enclosure which can be buried in the ground and which can permit the wires to be slightly adjusted after the enclosure is buried in the ground without pinching the wires and without pulling the enclosure out of the ground.

It is another object of the present invention to provide an electrical splice enclosure which is a two piece enclosure having a separate hollow body being partially filled with a waterproof substance and a separate cap which can be locked in place on the hollow body in a manner which permits the wires to exit the closed container and at the same time retaining the wires without causing them to be pinched against the container or cover. At the same time, the cover provides means to assure that the wire connecting means and connected ends will not be pulled out of the waterproof substance.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the entire present invention waterproof electrical splice enclosure with specialized housing to prevent the wires from being removed from the waterproof material within the housing.

FIG. 2 is a cross-sectional elevational view of the hollow container body and the top removed from the container body, illustrating the transverse rod and the aligned openings in the body and cover.

FIG. 3 is a cross-sectional elevational view of the hollow container body being partially filled with waterproof substance and a multiplicity of connected wires being connected by a wire connection means and with the wire connection means and connected wires being retained within the waterproof substance by the transverse rod connected to the interior surface of the cover.

FIG. 4 is an enlarged cross-sectional view of the connecting means which connects the cover to the hollow container body, prior to the connection being made.

FIG. 5 is an enlarged cross-sectional view of the connecting means which connects the cover to the hollow container body, after the two elements are connected.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring particularly to FIGS. 1 through 3, there is shown at 10 the entire electrical splice enclosure assembly. The splice enclosure container 20, comprises two separate sections, a hollow body member 30 and a separate cover 60. The hollow body member 30 is enclosed at its bottom and includes a bottom wall 32 and a multiplicity of sidewalls. In the illustration in FIG. 1, there are six sidewalls, 34, 36, 38, 40, 42 and 44. Therefore, in cross-section the six sidewalls form a hexagon. It will be appreciated that the present invention electrical splice enclosure can be formed into a hollow body member 30 having any desired multiplicity of sidewalls from three up. However, the preferred embodiment is to have six sidewalls of even width and height. The top 46 of the hollow body member 30 is open. The multiplicity of sidewalls 34, 36, 38, 40, 42 and 44 and the bottom 32 define an interior chamber 48. The top of a selected number of the sidewalls has an opening which in the preferred embodiment is generally semicircular. Sidewalls 36 and 38 have semicircular openings 50 and 52. Sidewalls 42 and 44 have semicircular openings 56 and 54 respectively.

Separate cover 60 fits onto hollow body member 30 so that it can be locked in place. The cross-sectional shape of the cover 60 is formed to correspond to the cross-sectional shape of the multiplicity of sidewalls. Therefore, in the preferred embodiment, the cover 60 is generally hexagonal. Cover 60 comprises a top 62 and a multiplicity of cover sidewalls which correspond to the sidewalls of the hollow body member 30. The cover further has a multiplicity of openings in selected sidewalls which correspond to the selected openings the sidewalls of the hollow body member. As illustrated in FIG. 1, cover sidewall 64 corresponds to hollow body member sidewall 36 and cover sidewall 64 has opening 66 which is aligned with opening 50. Similarly, cover sidewall 68 is aligned with hollow body member sidewall 38 and has opening 70 which is aligned with opening 52. Similarly, referring to FIG. 2, opening 61 is aligned with opening 54 and opening 63 is aligned with opening 56. In the preferred embodiment, the openings in the cover sidewalls are also semicircular. Therefore, when aligned with the openings in the hollow body member sidewalls, they form a full circle having a sufficient diameter to permit at least one wire to pass through each fully formed opening. As illustrated in FIG. 1, in the preferred hexagonal shape, there are four sets of aligned openings to thereby permit at least four wires to extend through the openings.

Hollow body member 30 and cover 60 further have at least one and preferably two locking members. A locking member is illustrated in FIGS. 4 and 5. Adjacent its top 46, hollow body member 30 has a lock receiving member 80 which extends transversely to a sidewall. Lock receiving member 80 comprises a transverse shelf 82 having an opening 84 extending through the entire thickness of the transverse shelf 82 and aligned generally parallel to the sidewall from which the receiving member extends. The cover 60 has a locking member 90 which includes a transverse shelf 92 which extends from the top 60 and generally perpendicular to a cover sidewall and an engaging member 94 which extends generally perpendicular to the transverse shelf 92 and generally parallel to the cover sidewall. The engaging member has a leading edge 96 which extends through opening 84 and a transverse trailing edge 98 which catches under the shelf 82 to thereby lock the cover in place. In the embodiment illustrated in FIG. 4, the engaging member 94 is generally right triangular, with the leading edge 96 being the tip of the right triangle and the trailing edge 98 being the base of the right triangle. A stem 100 supports the engaging member 94 from the shelf 92 in a spaced apart location such that the distance "d" between the shelf 92 and trailing edge 98 is slightly greater than the thickness "t" of transverse shelf 82. When fully pressed through the shelf opening 84, engagement member 94 serves to lock the cover 60 onto the hollow body member 30. In the preferred embodiment, there are two oppositely disposed locking arrangements, as illustrated in FIG. 1.

The interior surface of cover top 62 further comprises a transverse rod 65 which extends generally perpendicular to the interior surface and therefore extends into the hollow chamber 48 when the cover 60 is locked in place on the hollow body member 30 in the manner just described. As illustrated in FIG. 3, the rod 65 extends for at least one third of the depth of the hollow chamber 48.

Hollow body member 30 is partially filled with a waterproof substance 112 which in the preferred embodiment is a waterproof gel. The waterproof gel should have sufficient viscosity so that it will not flow out of the chamber 48 but at the same time should be sufficiently fluid to permit a connector means and wires to be immersed in the waterproof gel 112. The waterproof gel 112 preferably fills at least two thirds of the depth of the container 48.

A multiplicity of wires are connected together by a connecting means. In the illustration in FIG. 3, four such wires 102, 104, 106 and 108 have had the insulation adjacent their respective ends stripped away and are pressed together and then connected by a conventional connecting means 110. The connecting means 110 and connected wires 102, 104, 106 and 108 are then immersed in the waterproof substance 112 and the cover 60 is locked in placed as previously described. A respective wire fits through a respective aligned set of openings between the cover 60 and the hollow body member 30, as illustrated in FIG. 1. As illustrated in FIG. 3, the rod 65 prevents the connecting means 110 and connected ends of the wires from being entirely pulled out of the waterproof substance 112 because the rod 65 is generally centrally disposed on the interior surface 61 of cover top 62 and extends for a sufficient length so that it is beyond the level of the waterproof substance 112. Therefore, the wires and connecting means are retained within the waterproof substance 112 while at the same time the wires 102, 104, 106 and 108 are free to move for a slight distance to thereby enable a user to provide slight length adjustments when connecting the respective wires at their other ends. The wires are not pinched against the hollow body member 30 or top 60 and the entire spliced assembly can be moved within the waterproof substance 112.

Cover top 62 further comprises a webbed opening 75. This webbed opening is used to add waterproof substance 112 if required into the hollow body member 30, after the connecting means 110 and multiplicity of wires 102, 104, 106 and 108 have been inserted into the hollow body member 30 and either when hollow body member is empty or after it has been partially filled with waterproof substance 112. Therefore, the user can partially fill the hollow body member 30 with waterproof substance, insert the connecting means and wires, close the cover 60 and then if more waterproof substance is needed, insert the tip of the waterproof compound container through the webbed opening 75 and fill the remainder of the hollow body member 30 with the required amount of waterproof compound 112.

Although the hollow body member has been described as having a multiplicity of sidewalls, it will be appreciated that it is also within the spirit and scope of the present invention for the hollow body member to have a single sidewall to thereby form a generally cylindrical hollow body member. Similarly, the cover may also have a single interior sidewall In this case, the respective openings in the top of the interior hollow body member sidewall and the bottom of the cover sidewall are aligned to form a selective set of corresponding openings.

Although the hollow body member and cover can be made of any desired material, in the preferred embodiment they are each made of plastic.

Therefore, the present invention can be generally defined as a waterproof electrical splice enclosure for retaining a multiplicity of wires which are connected together by a wire connecting means, comprising: (a) a hollow body member including a bottom and a multiplicity of connected transverse sidewalls of equal height and width, each sidewall having a bottom edge and a top edge, with each sidewall attached to the bottom at its respective bottom edge, with the bottom and sidewalls defining an interior chamber within the hollow body member; (b) a selected subset of said multiplicity of sidewalls having an opening extending out of their respective top edges; (c) a separate cover including a top and a multiplicity of connected transverse sidewalls of equal height and width, with each sidewall having a top edge and a bottom edge, with each sidewall attached to the cover top at its respective top edge, and a selected subset of said multiplicity of sidewalls having an opening extending out of their respective bottom edges; (d) the sidewalls of the hollow body member aligned to correspond with the sidewalls of the cover when the cover is placed onto the hollow body member, with a respective opening in the top edge of the sidewalls of the hollow body member aligned with a respective opening in the bottom edge of the sidewalls of the cover to thereby define a selected subset of openings between the cover and the hollow body member; (e) the cover top further comprising an inner surface facing the interior chamber of the hollow body member when the cover is attached to the hollow body member and further comprising a rod extending transversely from the inner surface of the cover top and extending into the interior chamber; (f) the interior chamber of the hollow body member at least partially filled with a waterproof substance; and (g) locking means for attaching the cover to said hollow body member; (h) whereby when said wire connecting means and the connected ends of said multiplicity of connected wires are in an opened hollow body member and immersed in the waterproof substance, the cover is locked in place on the hollow body member such that a respective one wire extends through a formed opening between the hollow body member and the cover and the rod prevents the wire connecting means and the wire ends from being pulled out of the waterproof substance.

The locking means may comprise: (a) a lock receiving member having a transverse shelf extending generally perpendicularly to a selected sidewall of the hollow body member and an opening extending through the transverse shelf in a direction generally parallel to the sidewall; and (b) a lock receiving member having a transverse shelf which extends from the cover top and generally perpendicular to a cover sidewall and an engaging member which extends generally perpendicular to the transverse shelf and generally parallel to the cover sidewall, the engaging member having a leading edge which extends through the opening in the lock receiving member and a trailing edge which is locked in place against the transverse shelf of the lock receiving member.

In the preferred embodiment, the interior chamber of the hollow body member is filled to a level of at least two thirds of its depth with said waterproof substance and said rod extends into the interior chamber of the hollow body member for a distance of at least one third of the depth of the interior chamber.

The formed openings between the hollow body member and the cover are sufficiently large to permit a selected wire to move freely through the formed opening.

Defined more broadly, the present invention is a waterproof electrical splice enclosure for retaining a multiplicity of wires which are connected together by a wire connecting means, comprising: (a) an open hollow body member having a bottom and a sidewall to form an interior chamber with selected areas of the sidewall having openings in the edge against the opening; (b) a separate cover including a top and a sidewall, with selected areas of the sidewall having openings in the edge remote form the top; (c) the sidewall of the hollow body member aligned to correspond with the sidewall of the cover when the cover is placed onto the hollow body member, with a respective opening in the edge of the sidewall of the hollow body member aligned with a respective opening in the edge of the sidewall of the cover to thereby define a selected subset of openings between the cover and the hollow body member; (d) the cover top further comprising an inner surface facing the interior chamber of the hollow body member when the cover is attached to the hollow body member and further comprising a rod extending transversely from the inner surface of the cover top and extending into the interior chamber; (e) the interior chamber of the hollow body member at least partially filled with a waterproof substance; and (f) locking means for attaching the cover to said hollow body member; (g) whereby when said wire connecting means and the connected ends of said multiplicity of connected wires are in an opened hollow body member and immersed in the waterproof substance, the cover is locked in place on the hollow body member such that a respective one wire extends through a formed opening between the hollow body member and the cover and the rod prevents the wire connecting means and the wire ends from being pulled out of the waterproof substance.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms of modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent protection to be granted.

What is claimed is:

1. A waterproof electrical splice enclosure for retaining a multiplicity of wires which are connected together by a wire connecting means, comprising:

a. a hollow body member including a bottom and a multiplicity of connected transverse sidewalls of equal height and width, each sidewall having a bottom edge and a top edge, with each sidewall attached to the bottom at its respective bottom edge, with the bottom and sidewalls defining an interior chamber within the hollow body member;

b. a selected subset of said multiplicity of sidewalls having an opening extending out of their respective top edges;

c. a separate cover including a top and a multiplicity of connected transverse sidewalls of equal height and width, with each sidewall having a top edge and a bottom edge, with each sidewall attached to the cover top at its respective top edge, and a selected subset of said multiplicity of sidewalls having an opening extending out of their respective bottom edges;

d. the sidewalls of the hollow body member aligned to correspond with the sidewalls of the cover when the cover is placed onto the hollow body member, with a respective opening in the top edge of the sidewalls of the hollow body member aligned with a respective opening in the bottom edge of the sidewalls of the cover to thereby define a selected subset of openings between the cover and the hollow body member;

e. the cover top further comprising an inner surface facing the interior chamber of the hollow body member when the cover is attached to the hollow body member and further comprising a rod extending transversely from the inner surface of the cover top and extending into the interior chamber;

f. the interior chamber of the hollow body member at least partially filled with a waterproof substance; and g. locking means for attaching the cover to said hollow body member;

h. whereby when said wire connecting means and the connected ends of said multiplicity of connected wires are in an opened hollow body member and immersed in the waterproof substance, the cover is locked in place on the hollow body member such that a respective one wire extends through a formed opening between the hollow body member and the cover and the rod prevents the wire connecting means and the wire ends from being pulled out of the waterproof substance.

2. A waterproof electrical splice enclosure in accordance with claim 1 wherein said locking means further comprises:

a. a lock receiving member having a transverse shelf extending generally perpendicularly to a selected sidewall of the hollow body member and an opening extending through the transverse shelf in a direction generally parallel to the sidewall; and b. a lock receiving member having a transverse shelf which extends from the cover top and generally perpendicular to a cover sidewall and an engaging member which extends generally perpendicular to the transverse shelf and generally parallel to the cover sidewall, the engaging member having a leading edge which extends through the opening in the lock receiving member and a trailing edge which is locked in place against the transverse shelf of the lock receiving member.

3. A waterproof electrical splice enclosure in accordance with claim 2 further comprising a pair of oppositely disposed locking means located on opposite hollow body member sidewalls and opposite cover sidewalls.

4. A waterproof electrical splice enclosure in accordance with claim 1 wherein the interior chamber of the hollow body member is filled to a level of at least two thirds of its depth with said waterproof substance and said rod extends into the interior chamber of the hollow body member for a distance of at least one third of the depth of the interior chamber.

5. A waterproof electrical splice enclosure in accordance with claim 1 wherein said hollow body member comprises six sidewalls and said cover top comprises six sidewalls, each set of six sidewalls forming a hexagon, and four of the sidewalls have aligned openings at the location of the top edge of sidewalls of the hollow body member and the bottom edge of the cover sidewalls, and two oppositely disposed cover sidewalls and respectively aligned oppositely disposed hollow body member sidewalls have locking means thereon.

6. A waterproof electrical splice enclosure in accordance with claim 1 wherein said waterproof substance is waterproof gel.

7. A waterproof electrical splice enclosure in accordance with claim 1 wherein said hollow body member and said cover are each made of plastic.

8. A waterproof electrical splice enclosure in accordance with claim 1 wherein said formed openings between the hollow body member and the cover are sufficiently large to permit a selected wire to move freely through the formed opening.

9. A waterproof electrical splice enclosure in accordance with claim 1 wherein said cover further comprises a webbed opening.

10. A waterproof electrical splice enclosure for retaining a multiplicity of wires which are connected together by a wire connecting means, comprising:

a. an open hollow body member having a bottom and a sidewall to form an interior chamber with selected areas of the sidewall having openings in the edge against the opening;

b. a separate cover including a top and a sidewall, with selected areas of the sidewall having openings in the edge remote form the top;

c. the sidewall of the hollow body member aligned to correspond with the sidewall of the cover when the cover is placed onto the hollow body member, with a respective opening in the edge of the sidewall of the hollow body member aligned with a respective opening in the edge of the sidewall of the cover to thereby define a selected subset of openings between the cover and the hollow body member;

d. the cover top further comprising an inner surface facing the interior chamber of the hollow body member when the cover is attached to the hollow body member and further comprising a rod extending transversely from the inner surface of the cover top and extending into the interior chamber;

e. the interior chamber of the hollow body member at least partially filled with a waterproof substance; and f. locking means for attaching the cover to said hollow body member;

g. whereby when said wire connecting means and the connected ends of said multiplicity of connected wires are in an opened hollow body member and immersed in the waterproof substance, the cover is locked in place on the hollow body member such that a respective one wire extends through a formed opening between the hollow body member and the cover and the rod prevents the wire connecting means and the wire ends from being pulled out of the waterproof substance.

11. A waterproof electrical splice enclosure in accordance with claim 10 wherein said locking means further comprises:

a. a lock receiving member having a transverse shelf extending generally perpendicularly to the sidewall of the hollow body member and an opening extending through the transverse shelf in a direction generally parallel to the sidewall; and b. a lock receiving member having a transverse shelf which extends from the cover top and generally perpendicular to the cover sidewall and an engaging member which extends generally perpendicular to the transverse shelf and generally parallel to the cover sidewall, the engaging member having a leading edge which extends through the opening in the lock receiving member and a trailing edge which is locked in place against the transverse shelf of the lock receiving member.

12. A waterproof electrical splice enclosure in accordance with claim 11 further comprising a pair of oppositely disposed locking means located on opposite locations of the hollow body member sidewall and cover sidewall.

13. A waterproof electrical splice enclosure in accordance with claim 10 wherein the interior chamber of the hollow body member is filled to a level of at least two thirds of its depth with said waterproof substance and said rod extends into the interior chamber of the hollow body member for a distance of at least one third of the depth of the interior chamber.

14. A waterproof electrical splice enclosure in accordance with claim 10 wherein said waterproof substance is waterproof gel.

15. A waterproof electrical splice enclosure in accordance with claim 10 wherein said hollow body member and said cover are each made of plastic.

16. A waterproof electrical splice enclosure in accordance with claim 10 wherein said formed openings between the hollow body member and the cover are sufficiently large to permit a selected wire to move freely through the formed opening.

17. A waterproof electrical splice enclosure in accordance with claim 10 wherein said cover further comprises a webbed opening.

* * * * *